US006058349A

United States Patent [19]

Kikori et al.

[11] Patent Number: 6,058,349

[45] Date of Patent: May 2, 2000

[54] ACCELERATOR OPENING DEGREE DETECTION APPARATUS

[75] Inventors: Shigeo Kikori, Toyota; Osamu Fukasawa, Kariya; Hiroshi Mizuno, Toyota; Katsuyuki Kawai, Higashikamo-gun; Mitsuru Takada, Aichi-gun, all of Japan

[73] Assignee: Toyota Jidosha Kabushiki Kaisha & Denso Corp., Aichi-Ken, Japan

[21] Appl. No.: 08/975,141

[22] Filed: Nov. 20, 1997

[30] Foreign Application Priority Data

Dec. 19, 1996 [JP] Japan ..... 8-340176

[51] Int. Cl.[7] ..... F02D 9/02; F02D 41/04

[52] U.S. Cl. ..... 701/114; 123/399; 123/361

[58] Field of Search ..... 123/399, 361, 123/396; 701/114

[56] References Cited

U.S. PATENT DOCUMENTS

| | | | |
|---|---|---|---|
| 4,976,239 | 12/1990 | Hosaka | 123/399 |
| 5,167,212 | 12/1992 | Peter et al. | 123/399 |
| 5,445,125 | 8/1995 | Allen | 123/399 |
| 5,449,956 | 9/1995 | Williams | 123/396 |
| 5,602,732 | 2/1997 | Nichols et al. | 123/361 |
| 5,749,343 | 5/1998 | Nichols et al. | 123/396 |
| 5,775,294 | 7/1998 | Kojima et al. | 123/399 |

FOREIGN PATENT DOCUMENTS

| | | |
|---|---|---|
| 61-7429 | 1/1986 | Japan . |
| 61-7431 | 1/1986 | Japan . |
| 61-8433 | 1/1986 | Japan . |
| 61-279743 | 12/1986 | Japan . |

*Primary Examiner*—Willis R. Wolfe
*Assistant Examiner*—Hien T. Vo
*Attorney, Agent, or Firm*—Kenyon & Kenyon

[57] ABSTRACT

The accelerator opening degree detection apparatus of the present invention includes: an accelerator pedal position sensor for detecting a position of an accelerator pedal; and a calculating section for calculating an accelerator opening degree based on an output of the accelerator pedal position sensor. The calculating section performs at least the following steps of: obtaining a signal PDLAD by smoothing the output of the accelerator pedal position sensor with a first smoothing coefficient; obtaining a signal PDLSM by smoothing the output of the accelerator pedal position sensor with a second smoothing coefficient which is larger than the first smoothing coefficient; storing a reference value GPDL representing a reference position of the accelerator pedal position sensor; calculating an accelerator opening degree PDLA based on a difference between the signal PDLAD and the reference value GPDL; and updating the reference value GPDL based on the signal PDLSM if the accelerator opening degree PDLA satisfies a predetermined update condition.

18 Claims, 5 Drawing Sheets

ACCELERATOR OPENING DEGREE DETECTION APPARATUS

BACKGROUND OF THE INVENTION

Field of the Invention

The present invention relates to an accelerator opening degree detection apparatus for detecting an accelerator opening degree.

Description of the Related Art

Japanese Laid-Open Publication No. 61-8433 discloses the techniques of providing an accelerator totally closing switch and to determine a reference point (i.e., a zero point) of an accelerator pedal position sensor based on a signal representing the ON/OFF states of the accelerator totally closing switch.

In accordance with the techniques disclosed in Japanese Laid-Open Publication No. 61-8433, an accelerator totally closing switch is required to be provided separately from an accelerator pedal position sensor. Thus, the technique has a problem in that the costs are adversely increased. In addition, if the accelerator totally closing switch is out of order, then a problem is caused in that the reference position (zero point) of the accelerator pedal position sensor cannot be precisely determined.

SUMMARY OF THE INVENTION

The accelerator opening degree detection apparatus of the present invention includes: an accelerator pedal position sensor for detecting a position of an accelerator pedal; and a calculating section for calculating an accelerator opening degree based on an output of the accelerator pedal position sensor. The calculating section performs at least the following steps of: obtaining a signal PDLAD by smoothing the output of the accelerator pedal position sensor with a first smoothing coefficient; obtaining a signal PDLSM by smoothing the output of the accelerator pedal position sensor with a second smoothing coefficient which is larger than the first smoothing coefficient; storing a reference value GPDL representing a reference position of the accelerator pedal position sensor; calculating an accelerator opening degree PDLA based on a difference between the signal PDLAD and the reference value GPDL; and updating the reference value GPDL based on the signal PDLSM if the accelerator opening degree PDLA satisfies a predetermined update condition.

In one embodiment, the reference value GPDL is updated if the accelerator opening degree PDLA continuously satisfies the predetermined update condition over a predetermined period of time.

In another embodiment, the calculation section further performs the step of prohibiting an increment of the reference value GPDL from exceeding a predetermined upper limit value during a predetermined period of time.

The accelerator opening degree detection apparatus according to another aspect of the present invention includes: an accelerator pedal position sensor having a first sensor and a second sensor, each of the first sensor and the second sensor detecting a position of an accelerator pedal; and a calculating section for calculating an accelerator opening degree based on an output of the accelerator pedal position sensor. The calculating section performs at least the following steps of: obtaining a signal PDLAD1 by smoothing the output of the first sensor with a first smoothing coefficient; obtaining a signal PDLSM1 by smoothing the output of the first sensor with a second smoothing coefficient which is larger than the first smoothing coefficient; storing a first reference value GPDL1 representing a reference position of the first sensor; calculating a first accelerator opening degree PDLA1 based on a difference between the signal PDLAD1 and the first reference value GPDL1; obtaining a signal PDLAD2 by smoothing the output of the second sensor with a third smoothing coefficient; obtaining a signal PDLSM2 by smoothing the output of the second sensor with a fourth smoothing coefficient which is larger than the third smoothing coefficient; storing a second reference value GPDL2 representing a reference position of the second sensor; calculating a second accelerator opening degree PDLA2 based on a difference between the signal PDLAD2 and the second reference value GPDL2; updating the first reference value GPDL1 based on the signal PDLSM1 if the first accelerator opening degree PDLA1 satisfies a first predetermined update condition or if the second accelerator opening degree PDLA2 satisfies a second predetermined update condition; and updating the second reference value GPDL2 based on the signal PDLSM2 if the second accelerator opening degree PDLA2 satisfies the second predetermined update condition.

Thus, the invention described herein makes possible the advantage of providing an accelerator opening degree detection apparatus which can precisely determine the reference position of an accelerator pedal position sensor without providing an accelerator totally closing switch.

This and other advantages of the present invention will become apparent to those skilled in the art upon reading and understanding the following detailed description with reference to the accompanying figures.

BRIEF DESCRIPTION OF THE DRAWINGS

FIG. 4A is a timing chart showing a relationship between an actual accelerator opening degree and an accelerator opening degree PDLA output from the accelerator opening degree detection apparatus 1, while

DESCRIPTION OF THE PREFERRED EMBODIMENTS

Hereinafter, the embodiments of the present invention will be described with reference to the accompanying drawings.

Embodiment 1

Figure 1:
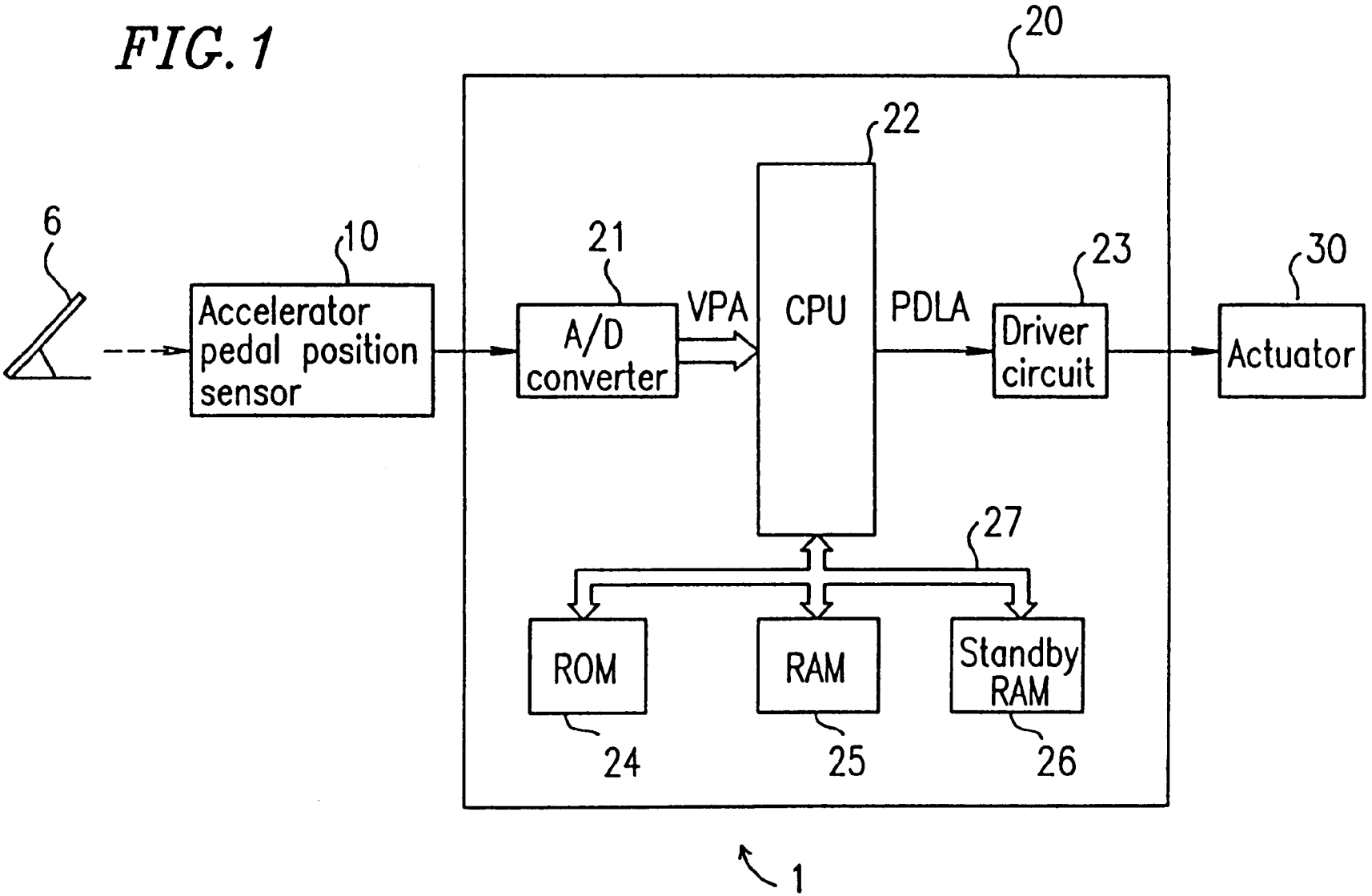
FIG. 1 is a block diagram showing a configuration of an accelerator opening degree detection apparatus 1 in a first embodiment of the present invention.

FIG. 1 shows a configuration of an accelerator opening degree detection apparatus 1 in a first embodiment of the present invention. The accelerator opening degree detection apparatus 1 includes an accelerator pedal position sensor 10 and an electronic control unit (ECU) 20.

The accelerator pedal position sensor 10 detects the position of the accelerator pedal 6 based on the amount by which the accelerator pedal 6 has been depressed, thereby outputting a detection signal representing the position of the accelerator pedal 6 to the ECU 20. The accelerator pedal position sensor 10 may be implemented as a potentiometer, for example.

The ECU 20 includes: an analog-to-digital (A/D) converter 21; a CPU 22; a driver circuit 23; a read-only memory (ROM) 24; a random access memory (RAM) 25; and a standby RAM 26. The CPU 22, the ROM 24, the RAM 25 and the standby RAM 26 are coupled to each other via a bus 27.

The A/D converter 21 converts the detection signal, output from the accelerator pedal position sensor 10 as an analog value, into a digital value. The detection signal converted into the digital value (hereinafter, referred to as a signal VPA) is input to the CPU 22.

In response to the signal VPA, the CPU 22 calculates an accelerator opening degree PDLA and then outputs the accelerator opening degree PDLA to the driver circuit 23. The accelerator opening degree PDLA is calculated based on a reference value GPDL representing the reference position of the accelerator pedal position sensor 10.

The driver circuit 23 drives an actuator 30 based on the accelerator opening degree PDLA. The actuator may be a motor for controlling the opening degree of a throttle valve, for example.

Figure 2:
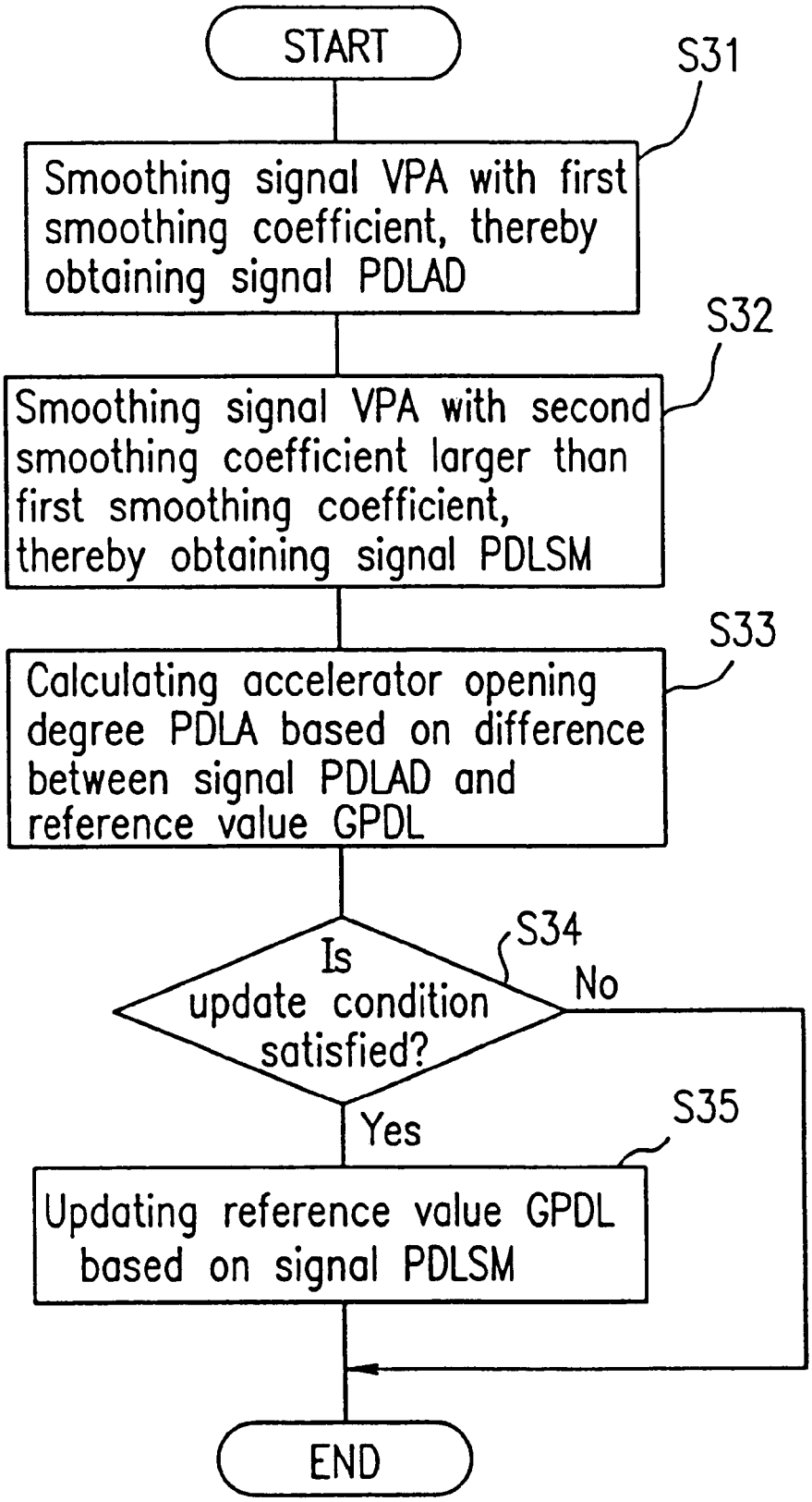
FIG. 2 is a flow chart illustrating an accelerator opening degree detection process procedure.

FIG. 2 illustrates an accelerator opening degree detection process procedure. The accelerator opening degree detection process is stored in the form of a program in the ROM 24. The CPU 22 reads out the program for the accelerator opening degree detection process and executes the program every time a predetermined time has passed.

Hereinafter, the accelerator opening degree detection process will be described step by step with reference to FIG. 2.

First, in Step S31, the CPU 22 smooths the signal VPA with a first smoothing coefficient, thereby obtaining a signal PDLAD. The signal PDLAD may be obtained by executing the following recurrence formula (1), for example.

$$PDLAD_i=PDLAD_{i-1}+(VPA-PDLAD_{i-1})/2 \quad (1)$$

In this case, the CPU 22 stores $PDLAD_i$ which was updated most recently as the signal PDLAD in the RAM 25. In the example shown in formula (1), the first smoothing coefficient is 2.

In Step S32, the CPU 22 smooths the signal VPA with a second smoothing coefficient larger than the first smoothing coefficient, thereby obtaining a signal PDLSM. The signal PDLSM may be obtained by executing the following recurrence formula (2), for example.

$$PDLSM_i=PDLSM_{i-1}+(VPA-PDLSM_{i-1})/32 \quad (2)$$

In this case, the CPU 22 stores $PDLSM_i$ which was updated most recently as the signal PDLSM in the RAM 25. In the example shown in formula (2), the second smoothing coefficient is 32.

In Step S33, the CPU 22 calculates the accelerator opening degree PDLA based on a difference between the signal PDLAD and a reference value GPDL representing the reference position of the accelerator pedal position sensor 10. Before the accelerator opening degree detection process is started, the reference value GPDL is set at an initial value. The reference value GPDL is stored in the standby RAM 26 such that the reference value GPDL is not erased but held therein even after the ignition has been turned OFF. The accelerator opening degree PDLA may be calculated based on the following equation (3), for example.

$$PDLA=PDLAD-GPDL \quad (3)$$

In Step S34, the CPU 22 determines whether or not the accelerator opening degree PDLA calculated in Step S33 satisfies a predetermined update condition. The predetermined update condition may be given by the following inequality (4).

$$PDLA \leqq PDLA_{TH} \quad (4)$$

where $PDLA_{TH}$ is a predetermined value indicating that PDLA is in the vicinity of the reference position. $PDLA_{TH}$ is a predetermined value, for example, from 1° to 2°, both inclusive.

Alternatively, in Step S34, a predetermined update condition may be a condition that the condition given by the inequality (4) is continuously satisfied over a predetermined period of time. This is because it takes a relatively long time for the value (i.e., the signal PDLSM) which has been smoothed with the second smoothing coefficient to catch up with the value (i.e., the signal PDLAD) which has been smoothed with the first smoothing coefficient.

If the decision result in Step S34 is "Yes", the process proceeds to Step S35. On the other hand, if the decision result in Step S34 is "No", the process skips Step S35 and ends.

In Step S35, the CPU 22 updates the reference value GPDL based on the signal PDLSM. The reference value GPDL may be updated based on the following recurrence formula (5), for example.

$$GPDL_i=GPDL_{i-1}+(PDLSM-GPDL_{i-1})/32 \quad (5)$$

In this case, the CPU 22 stores $GPDL_i$ which was updated most recently as the reference value GPDL in the standby RAM 26.

Alternatively, the reference value GPDL may be updated based on the following equation (6).

$$GPDL=PDLSM \quad (6)$$

In this way, in the accelerator opening degree detection process, the reference value GPDL is updated if the accelerator opening degree PDLA satisfies a predetermined update condition. Thus, the reference position of the accelerator pedal position sensor 10 can be determined without providing an accelerator totally closing switch.

Furthermore, the reference value GPDL is updated based on a value (i.e., the signal PDLSM) which has been smoothed by the second smoothing coefficient larger than the first smoothing coefficient. This makes it possible to prevent the reference position of the accelerator pedal position sensor 10 from being erroneously determined owing to the mixture of noises and the like. Furthermore, the accelerator opening degree PDLA is calculated based on a value (i.e., the signal PDLAD) which has been smoothed by the first smoothing coefficient smaller than the second smoothing coefficient. This makes it possible to detect a quick operation of the accelerator pedal 6.

Figure 3:
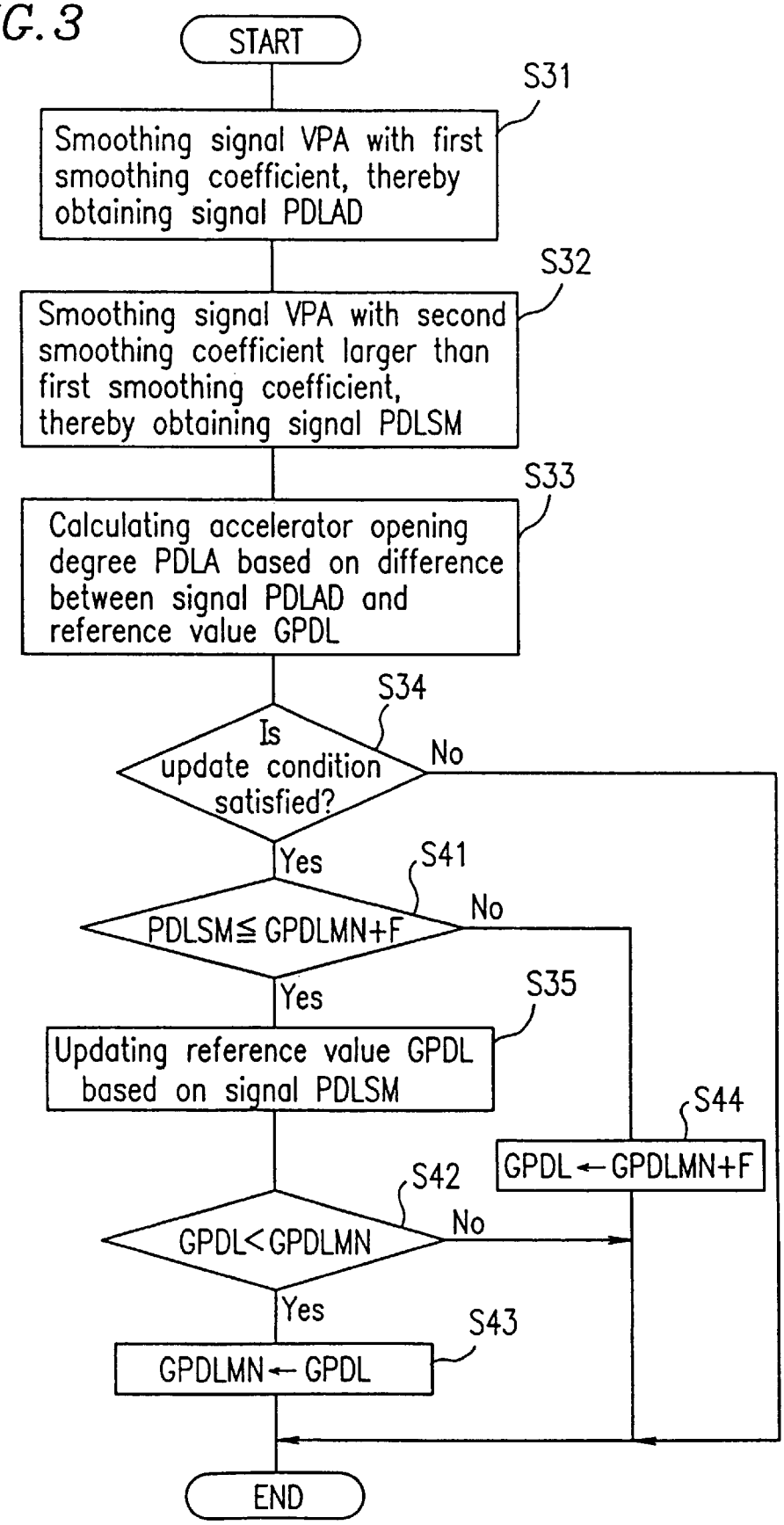
FIG. 3 is a flow chart illustrating a modified accelerator opening degree detection process procedure.

FIG. 3 illustrates a modified accelerator opening degree detection process procedure. This modified accelerator opening degree detection process procedure is provided for preventing the reference position of the accelerator pedal position sensor 10 from being erroneously determined in the case where the accelerator pedal has been depressed very slowly.

The accelerator opening degree detection process procedure illustrated in FIG. 3 is the same as the accelerator opening degree detection process procedure shown in FIG. 2 except that Steps S41 to S44 are additionally provided. Thus, the same process steps will be identified by the same reference numerals and the description thereof will be omitted herein.

In Step S41, the CPU 22 determines whether or not the following condition expressed by the inequality (7) is satisfied.

$$PDLSM \leqq GPDLMN+F \quad (7)$$

where GPDLMN represents the minimum value of the reference value GPDL during a period $T_1$. The period $T_1$ is a period between the turn-ON of the ignition and the turn-OFF of the ignition, for example. Alternatively, the period $T_1$ may be a period between the actuation of an engine and the stop of the engine. It is noted that the minimum value GPDLMN is initialized to be equal to the reference value GPDL at the time of the turn ON of the ignition. In addition, F represents a predetermined upper limit value.

If the condition expressed by the inequality (7) is satisfied in Step S41, the process proceeds to Step S42 via Step S35.

In Step S42, the CPU 22 determines whether or not the following condition expressed by the inequality (8) is satisfied.

$$GPDL<GPDLMN \quad (8)$$

where GPDL represents the reference value updated in Step S35.

If the condition expressed by the inequality (8) is satisfied in Step S42, the process proceeds to Step S43. On the other hand, if the condition expressed by the inequality (8) is not satisfied in Step S42, the process skips Step S43 and ends.

In Step S43, the CPU 22 updates the minimum value GPDLMN of the reference value GPDL during the period $T_1$ into the reference value GPDL updated in Step S35.

If the condition expressed by the inequality (7) is not satisfied in Step S41, the process proceeds to Step S44.

In Step S44, the CPU 22 updates the reference value GPDL into (GPDLMN+F).

In this way, the reference value GPDL is controlled such that the increment of the updated reference value GPDL does not exceed the predetermined value. Thus, even if the accelerator pedal has been depressed very slowly, it is possible to prevent the reference position of the accelerator pedal position sensor 10 from being erroneously determined.

Figure 4A:
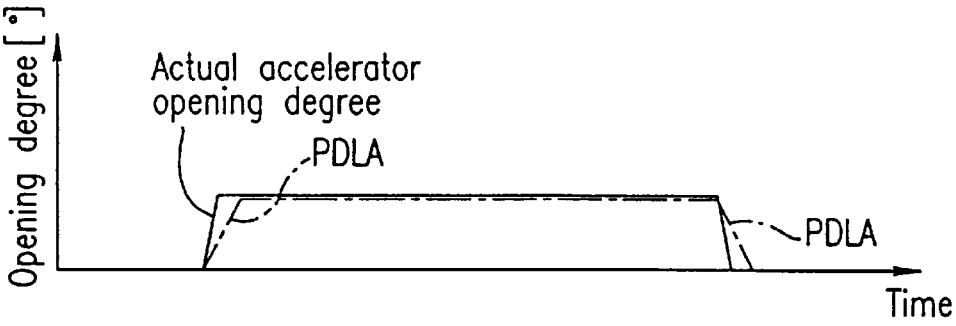
Figure 4B:
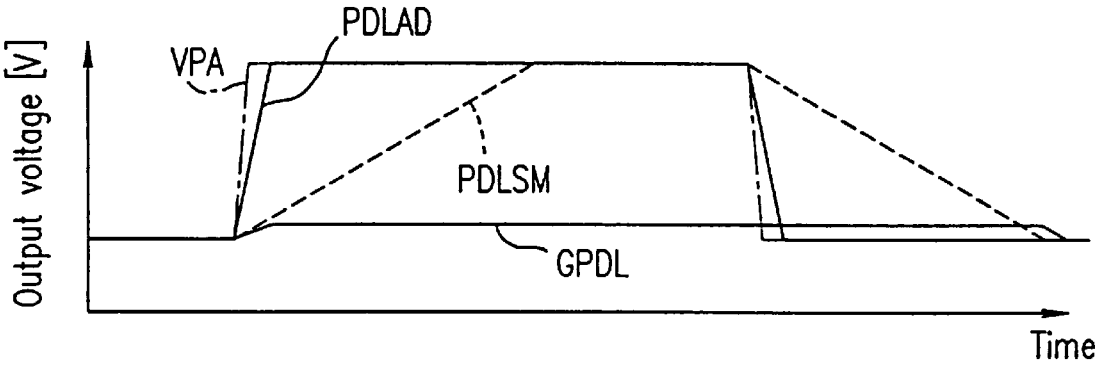
FIG. 4B is a timing chart showing a relationship among a signal VPA, a signal PDLSM, a signal PDLAD and a reference value GPDL.

FIG. 4A is a timing chart showing a relationship between an actual accelerator opening degree and an accelerator opening degree PDLA output from the accelerator opening degree detection apparatus 1, while FIG. 4B is a timing chart showing a relationship among the signal VPA, the signal PDLSM, the signal PDLAD and the reference value GPDL.

Embodiment 2

In the second embodiment, a case where the accelerator pedal position sensor 10 is a dual sensor will be described.

Figure 5:
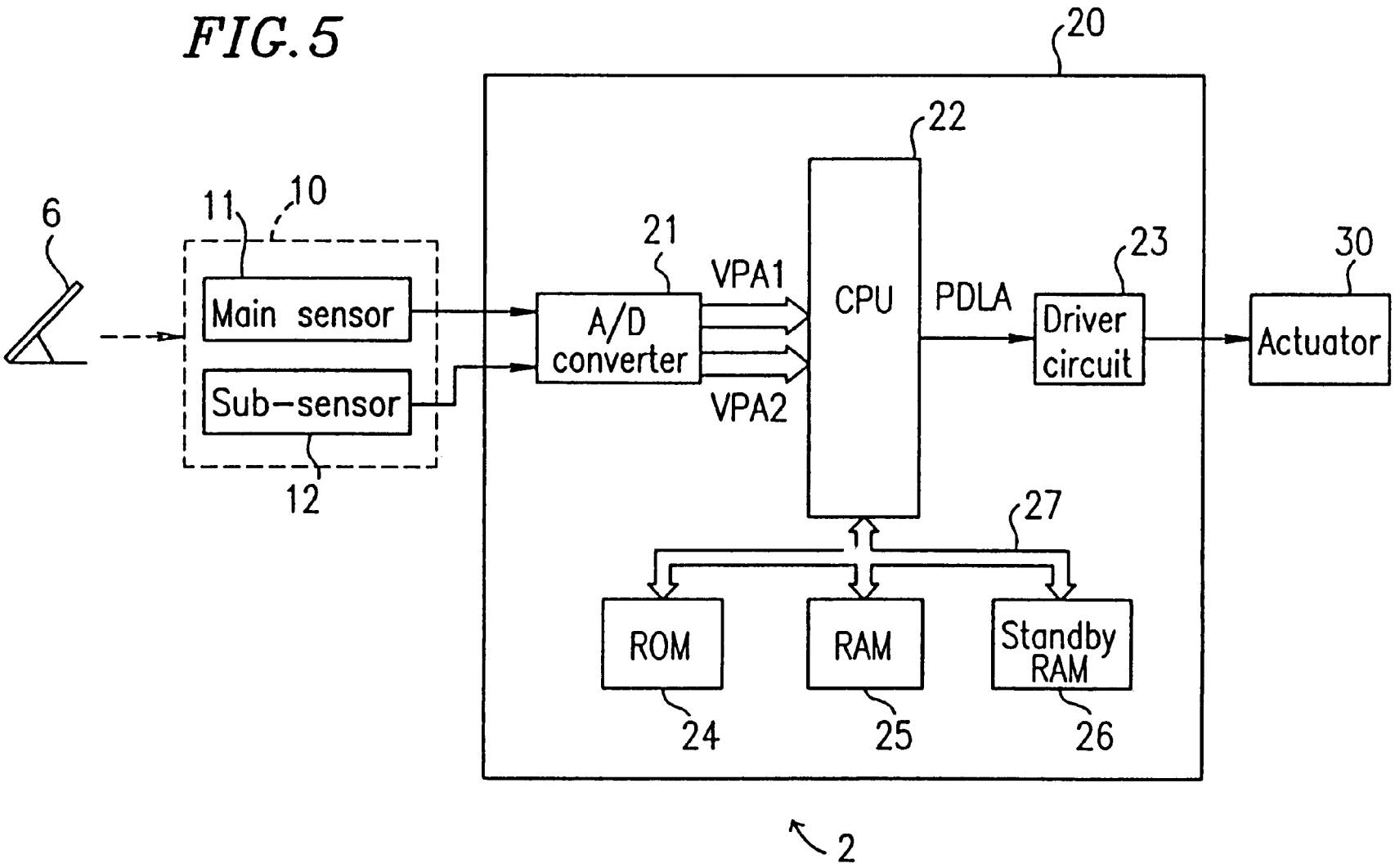
FIG. 5 is a block diagram showing a configuration of an accelerator opening degree detection apparatus 2 in a second embodiment of the present invention.

FIG. 5 shows a configuration of an accelerator opening degree detection apparatus 2 in the second embodiment of the present invention. The configuration of the accelerator opening degree detection apparatus 2 shown in FIG. 5 is the same as that of the accelerator opening degree detection apparatus 1 shown in FIG. 1 except that the accelerator pedal position sensor 10 includes a main sensor 11 and a sub-sensor 12. Thus the same components will be identified by the same reference numerals and the description thereof will be omitted herein.

The main sensor 11 detects the position of the accelerator pedal 6 based on the amount by which the accelerator pedal 6 has been depressed, thereby outputting a detection signal representing the position of the accelerator pedal 6 to the ECU 20. The main sensor 11 may be implemented as a potentiometer, for example.

The sub-sensor 12 also detects the position of the accelerator pedal 6 based on the amount by which the accelerator pedal 6 has been depressed, thereby outputting a detection signal representing the position of the accelerator pedal 6 to the ECU 20. The sub-sensor 12 may also be implemented as a potentiometer, for example.

The A/D converter 21 converts the detection signal, output from the main sensor 11 as an analog value, into a digital value. The detection signal converted into the digital value (hereinafter, referred to as a signal VPA1) is input to the CPU 22.

The A/D converter 21 also converts the detection signal, output from the sub-sensor 12 as an analog value, into a digital value. The detection signal converted into the digital value (hereinafter, referred to as a signal VPA2) is also input to the CPU 22.

The CPU 22 executes the accelerator opening degree detection process for the main sensor 11 and executes the accelerator opening degree detection process for the sub-sensor 12.

The accelerator opening degree detection process for the main sensor 11 is the same as the accelerator opening degree detection process shown in FIG. 2 or 3, except that the signal VPA is replaced with the signal VPA1 and that Step S34 is replaced with Step S34' to be described below.

In Step S34', the CPU 22 determines whether or not the accelerator opening degree PDLA1 calculated for the main sensor 11 satisfies a first predetermined update condition, and also determines whether or not the accelerator opening degree PDLA2 calculated for the sub-sensor 12 satisfies a second predetermined update condition. In this case, the first predetermined update condition may be a condition that a state indicating that the accelerator opening degree PDLA1 calculated for the main sensor 11 is in the vicinity of the reference position lasts for a predetermined period of time. Similarly, the second predetermined update condition may be a condition that a state indicating that the accelerator opening degree PDLA2 calculated for the sub-sensor 12 is in the vicinity of the reference position lasts for a predetermined period of time.

If the accelerator opening degree PDLA1 calculated for the main sensor 11 satisfies the first predetermined update condition, or if the accelerator opening degree PDLA2 calculated for the sub-sensor 12 satisfies the second predetermined update condition, the CPU 22 updates the reference value GPDL1 representing the reference position of the main sensor 11 in Step S35.

The accelerator opening degree detection process for the sub-sensor 12 is the same as the accelerator opening degree detection process shown in FIG. 2 or 3, except that the signal VPA is replaced with the signal VPA2. The CPU 22 updates the reference value GPDL2 representing the reference position of the sub-sensor 12 in Step S35 if the accelerator opening degree PDLA2 calculated for the sub-sensor 12 satisfies the second predetermined update condition.

In this way, the reference value GPDL1 representing the reference position of the main sensor 11 is updated if at least one of the update condition for the main sensor 11 and the update condition for the sub-sensor 12 has been satisfied. Thus, it is possible to reduce the possibility of erroneously determining the reference position of the main sensor 11.

According to the accelerator opening degree detection apparatus of the present invention, the reference value GPDL is updated if the accelerator opening degree PDLA satisfies a predetermined update condition. Thus, the reference position of the accelerator pedal position sensor can be determined without providing an accelerator totally closing switch. In addition, the reference value GPDL is updated based on the signal PDLSM which has been smoothed with a second smoothing coefficient larger than a first smoothing coefficient. Consequently, it is possible to prevent the reference position of the accelerator pedal position sensor from being erroneously determined owing to the mixture of noises and the like. Furthermore, the accelerator opening degree PDLA is calculated based on the signal PDLAD which has been smoothed with the first smoothing coefficient smaller than the second smoothing coefficient. Consequently, it is possible to detect a quick operation of the accelerator pedal.

Moreover, the reference value GPDL may be updated if the accelerator opening degree PDLA continuously satisfies the predetermined update condition over a predetermined period of time. This makes it possible to improve the precision of the reference value GPDL. This is because it takes a relatively long time for the signal PDLSM which has been smoothed with the second smoothing coefficient to catch up with the signal PDLAD which has been smoothed with the first smoothing coefficient.

Furthermore, the increment of the reference value GPDL may be prohibited from exceeding a predetermined upper limit value during a predetermined period. Thus, even if the accelerator pedal has been depressed very slowly, it is possible to prevent the reference position of the accelerator pedal position sensor from being erroneously determined.

According to another aspect of the accelerator opening degree detection apparatus of the present invention, the reference value GPDL1 representing the reference position of the first sensor is updated if the first accelerator opening degree PDLA1 of the first sensor satisfies the first predetermined update condition or if the second accelerator opening degree PDLA2 of the second sensor satisfies the second predetermined update condition. This makes it possible to reduce the possibility of erroneously determining the reference position of the first sensor.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. An accelerator opening degree detection apparatus comprising:

an accelerator pedal position sensor for detecting a position of an accelerator pedal; and a calculating section for calculating an accelerator opening degree based on an output of the accelerator pedal position sensor, wherein the calculating section performs at least the following steps of:

obtaining a signal PDLAD by smoothing the output of the accelerator pedal position sensor with a first smoothing coefficient;

obtaining a signal PDLSM by smoothing the output of the accelerator pedal position sensor with a second smoothing coefficient which is larger than the first smoothing coefficient;

storing a reference value GPDL representing a reference position of the accelerator pedal position sensor;

calculating an accelerator opening degree PDLA based on a difference between the signal PDLAD and the reference value GPDL; and updating the reference value GPDL based on the signal PDLSM if the accelerator opening degree PDLA satisfies a predetermined update condition.

2. The accelerator opening degree detection apparatus according to claim 1, wherein the reference value GPDL is updated if the accelerator opening degree PDLA continuously satisfies the predetermined update condition over a predetermined period of time.

3. The accelerator opening degree detection apparatus according to claim 1, wherein the calculation section further performs the step of prohibiting an increment of the reference value GPDL from exceeding a predetermined upper limit value during a predetermined period of time.

4. An accelerator opening degree detection apparatus comprising:

an accelerator pedal position sensor having a main sensor and a sub-sensor, each of the first sensor and the second sensor detecting a position of an accelerator pedal; and a calculating section for calculating an accelerator opening degree based on an output of the accelerator pedal position sensor, wherein the calculating section performs at least the following steps of:

obtaining a signal PDLAD1 by smoothing the output of the main sensor with a first smoothing coefficient;

obtaining a signal PDLSM1 by smoothing the output of the main sensor with a second smoothing coefficient which is larger than the first smoothing coefficient;

storing a first reference value GPDL1 representing a reference position of the main sensor;

calculating a first accelerator opening degree PDLA1 based on a difference between the signal PDLAD1 and the first reference value GPDL1;

obtaining a signal PDLAD2 by smoothing the output of the sub-sensor with a third smoothing coefficient;

obtaining a signal PDLSM2 by smoothing the output of the sub-sensor with a fourth smoothing coefficient which is larger than the third smoothing coefficient;

storing a second reference value GPDL2 representing a reference position of the sub-sensor;

calculating a second accelerator opening degree PDLA2 based on a difference between the signal PDLAD2 and the second reference value GPDL2;

updating the first reference value GPDL1 based on the signal PDLSM1 if the first accelerator opening degree PDLA1 satisfies a first predetermined update condition or if the second accelerator opening degree PDLA2 satisfies a second predetermined update condition; and updating the second reference value GPDL2 based on the signal PDLSM2 if the second accelerator opening degree PDLA2 satisfies the second predetermined update condition.

5. The accelerator opening degree detection apparatus according to claim 1, wherein the signal PDLAD is obtained by the following recurrence formula:

$$PDLAD_i = PDLAD_{i-1} + (VPA - PDLAD_{i-1})/SC_1$$

where VPA denotes a signal representing the output of the accelerator pedal position sensor, and $SC_1$ denotes the first smoothing coefficient.

6. The accelerator opening degree detection apparatus according to claim 1, wherein the signal PDLSM is obtained by the following recurrence formula:

$$PDLSM_i = PDLSM_{i-1} + (VPA - PDLSM_{i-1})/SC_2$$

where VPA denotes a signal representing the output of the accelerator pedal position sensor, and $SC_2$ denotes the second smoothing coefficient.

7. The accelerator opening degree detection apparatus according to claim 1, wherein the predetermined update condition is given by the following inequality:

$$PDLA \leq PDLA_{TH}$$

where $PDLA_{TH}$ is a predetermined value indicating that the accelerator opening degree PDLA is in the vicinity of the reference position of the accelerator pedal position sensor.

8. The accelerator opening degree detection apparatus according to claim 7, wherein $PDLA_{TH}$ is a predetermined value from 1 degree to 2 degrees, both inclusive.

9. The accelerator opening degree detection apparatus according to claim 1, wherein the reference value GPDL is updated by the following recurrence formula:

$$GPDL_i = GPDL_{i-1} + (PDLSM - GPDL_{i-1})/C$$

where C denotes a predetermined coefficient.

10. The accelerator opening degree detection apparatus according to claim 1, wherein the reference value GPDL is updated by the following equation:

$$GPDL = PDLSM.$$

11. The accelerator opening degree detection apparatus according to claim 4, wherein the first reference value GPDL1 is updated if the first accelerator opening degree PDLA1 continuously satisfies the first predetermined update condition over a predetermined period of time or if the second accelerator opening degree PDLA2 continuously satisfies the second predetermined update condition over a predetermined period of time, and wherein the second reference value GPDL2 is updated if the second accelerator opening degree PDLA2 continuously satisfies the second predetermined update condition over a predetermined period of time.

12. The accelerator opening degree detection apparatus according to claim 4, wherein the calculation section further performs the steps of:

prohibiting an increment of the first reference value GPDL1 from exceeding a predetermined upper limit value during a predetermined period of time; and prohibiting an increment of the second reference value GPDL2 from exceeding a predetermined upper limit value during a predetermined period of time.

13. The accelerator opening degree detection apparatus according to claim 4, wherein the signal PDLAD1 is obtained by the following recurrence formula:

$$PDLAD1_i = PDLAD1_{i-1} + (VPA1 - PDLAD1_{i-1})/SC_1$$

where VPA1 denotes a signal representing the output of the main sensor, and $SC_1$ denotes the first smoothing coefficient, and wherein the signal PDLAD2 is obtained by the following recurrence formula:

$$PDLAD2_i = PDLAD2_{i-1} + (VPA2 - PDLAD2_{i-1})/SC_3$$

where VPA2 denotes a signal representing the output of the sub-sensor, and $SC_3$ denotes the third smoothing coefficient.

14. The accelerator opening degree detection apparatus according to claim 4, wherein the signal PDLSM1 is obtained by the following recurrence formula:

$$PDLSM1_i = PDLSM1_{i-1} + (VPA1 - PDLSM1_{i-1})/SC_2$$

where VPA1 denotes a signal representing the output of the main sensor, and $SC_2$ denotes the second smoothing coefficient, and wherein the signal PDLSM2 is obtained by the following recurrence formula:

$$PDLSM2_i = PDLSM2_{i-1} + (VPA2 - PDLSM2_{i-1})/SC_4$$

where VPA2 denotes a signal representing the output of the sub-sensor, and $SC_4$ denotes the fourth smoothing coefficient.

15. The accelerator opening degree detection apparatus according to claim 4, wherein the first predetermined update condition is given by the following inequality:

$$PDLA1 \leqq PDLA1_{TH}$$

where $PDLA1_{TH}$ is a predetermined value indicating that the first accelerator opening degree PDLA1 is in the vicinity of the reference position of the main sensor, and wherein the second predetermined update condition is given by the following inequality:

$$PDLA2 \leqq PDLA2_{TH}$$

where $PDLA2_{TH}$ is a predetermined value indicating that the second accelerator opening degree PDLA2 is in the vicinity of the reference position of the sub-sensor.

16. The accelerator opening degree detection apparatus according to claim 15, wherein each of $PDLA1_{TH}$ and $PDLA2_{TH}$ is a predetermined value from 1 degree to 2 degrees, both inclusive.

17. The accelerator opening degree detection apparatus according to claim 4, wherein the reference value GPDL1 is updated by the following recurrence formula:

$$GPDL1_i = GPDL1_{i-1} + (PDLSM1 - GPDL1_{i-1})/C_1$$

and wherein the reference value GPDL2 is updated by the following recurrence formula:

$$GPDL2_i = GPDL2_{i-1} + (PDLSM2 - GPDL2_{i-1})/C_2$$

where $C_1$ and $C_2$ each denote a predetermined coefficient.

18. The accelerator opening degree detection apparatus according to claim 4, wherein the reference value GPDL1 is updated by the following equation:

$$GPDL1 = PDLSM1$$

and wherein the reference value GPDL2 is updated by the following equation:

$$GPDL2 = PDLSM2.$$

* * * * *